US006666037B2

(12) United States Patent
Hoshino et al.

(10) Patent No.: US 6,666,037 B2
(45) Date of Patent: Dec. 23, 2003

(54) ABSORPTION REFRIGERATOR CONTROL METHOD

(75) Inventors: Toshiyuki Hoshino, Tochigi-ken (JP); Masahiro Furukawa, Tochigi-ken (JP)

(73) Assignees: Sanyo Electric Co., Ltd., Osaka-fu (JP); Sanyo Electric Air Conditioning Co., Ltd., Tochigi-ken (JP)

( * ) Notice: Subject to any disclaimer, the term of this patent is extended or adjusted under 35 U.S.C. 154(b) by 0 days.

(21) Appl. No.: 10/158,778

(22) Filed: May 30, 2002

(65) Prior Publication Data

US 2002/0178739 A1 Dec. 5, 2002

(30) Foreign Application Priority Data

May 31, 2001 (JP) ..... 2001-165301

(51) Int. Cl.[7] ..... F25B 15/00

(52) U.S. Cl. ..... 62/148; 62/201; 62/185; 62/476; 62/101; 62/324.2

(58) Field of Search ..... 62/201, 148, 185, 62/476, 324.2, 101

(56) References Cited

U.S. PATENT DOCUMENTS

| | | | | | |
|---|---|---|---|---|---|
| 4,375,750 | A | * | 3/1983 | Blomberg | 62/101 |
| 4,429,541 | A | * | 2/1984 | Kamejima et al. | 62/201 |
| 4,691,525 | A | * | 9/1987 | Gelderloos | 62/101 |
| 5,749,244 | A | * | 5/1998 | Murayama et al. | 62/476 |
| 5,916,251 | A | * | 6/1999 | Sibik | 62/148 |
| 5,927,086 | A | * | 7/1999 | Suzuki et al. | 62/141 |
| 6,247,331 | B1 | * | 6/2001 | Nishiguchi et al. | 62/476 |
| 6,311,504 | B1 | * | 11/2001 | Yamazaki et al. | 62/141 |
| 6,487,874 | B2 | * | 12/2002 | Yamazaki et al. | 62/476 |

FOREIGN PATENT DOCUMENTS

JP 2001-263851 9/2001

* cited by examiner

*Primary Examiner*—William C. Doerrler
*Assistant Examiner*—Mark Shulman
(74) *Attorney, Agent, or Firm*—Weingarten, Schurgin, Gagnebin & Lebovici LLP

(57) ABSTRACT

An object of the invention is to enable heat sources to be surely utilized in accordance with order of priorities and to prevent a overshooting of a temperature of cold water supplied from an evaporator even when a load is immediately changed.

A flow of exhaust hot water supplied from a low-temperature heat source supply pipe to a low-temperature water regenerator is forcibly controlled to be the maximum. In such a state, when the cold water temperature measured by a temperature sensor becomes lower than a primary setting value of 7° C., the flow of exhaust hot water supplied from the low-temperature heat source supply pipe to the low-temperature water regenerator is controlled by starting again a PID control using 6° C. lower than the primary setting value of 7° C. as reference. Moreover, a flow of exhaust gas supplied from a high-temperature heat source supply pipe to a high-temperature regenerator is forcibly controlled to be zero. In this state, when the cold water temperature measured by a temperature sensor becomes 8° C. higher than the primary setting value of 7° C., the flow of the exhaust gas supplied from the high-temperature heat source supply pipe to the high-temperature regenerator is controlled by starting again the PID control using the primary setting value of 7° C. as reference.

3 Claims, 3 Drawing Sheets

ABSORPTION REFRIGERATOR CONTROL METHOD

BACKGROUND OF THE INVENTION

1. Field of the Invention

The present invention relates to an absorption refrigerator (including an absorption water chilling/heating machine), which is provided with two types of heat sources for generating refrigerant vapor by heating an absorption liquid.

2. Detailed Description of the Prior Art

An absorption refrigerator has been known, which heats an absorption liquid by use of high-temperature generated by combustion of natural gas, petroleum, or the like and exhaust heat from a cogeneration system or the like to evaporate and separate a refrigerant from the absorption liquid, and thus generates refrigerant vapor and a concentrated absorption liquid.

Another absorption refrigerator also has been known, in which exhaust heat supplied from both of exhaust hot water and exhaust gas of a cogeneration system using a gas engine or the like is utilized as heat sources.

In both cases, one heat source is preferentially used in accordance with a utilization form of heat of a user. In the light of an efficient use of heat, it is necessary that heat from a heat source to be preferentially used can be surely used.

In Japanese Patent Application 2000-074173, the inventors have proposed a control method, which sets two different values as temperature setting values of cold water cooled and supplied in an evaporator. The method controls a heating amount by one heat source based on one set temperature value, and controls a heating amount by the other heat source based on the other set temperature value.

By the proposed control method in Japanese Patent Application 2000-074173, the heat sources can be used in accordance with priorities. However, when the heating amount of the absorption fluid is controlled by means of a PID control setting a wide proportional band or a long integral time, immediate change of loads sometimes causes a disadvantage that the cold water is excessively cooled during the time of closing a fuel supply valve or confirming a fully-closed state thereof, and the apparatus is abnormally stopped. Accordingly, a control method without causing such disadvantage needs to be provided, which has been a problem to be solved.

SUMMARY OF THE INVENTION

The present invention solves the foregoing subjects of the prior arts by providing the following concrete means.

A first method of controlling an absorption refrigerator, which comprises the steps of: controlling a heating amount Q1 of an absorption liquid by a heat source A by means of a control using a first set temperature value T1 of cold water supplied from an evaporator as a reference value, the heat source A being to be preferentially used; controlling a residual heating amount Q2 of the absorption liquid by a heat source B by means of a control using a second set temperature value T2 higher than the first set temperature value T1 as a reference value; releasing heat of the refrigerant vapor for condensation in a condenser, the refrigerant vapor being evaporated and separated from the absorption liquid by heating the absorption liquid; evaporating the condensed liquid refrigerant in the evaporator; and supplying cold water cooled in the evaporation of the refrigerant in the evaporator to a load to perform a cooling operation such as air conditioning; wherein when the heating amount Q2 of the absorption liquid is continuously a minimum value for a predetermined time, the heating amount Q2 of the absorption liquid is forcibly controlled to be zero and the heating amount Q1 of the absorption liquid is controlled by means of the control using the first set temperature value T1 as a reference value, and wherein when the heating amount Q1 of the absorption liquid is continuously a maximum value for a predetermined time, the heating amount Q1 of the absorption liquid is forcibly controlled to be the maximum value and the heating amount Q2 of the absorption liquid is controlled by means of the control using the second set temperature value T2 as the reference value.

In the first method, a second method is provided, wherein in a state that the heating amount Q1 of the absorption liquid is forcibly controlled to be the maximum value, when a temperature T of the cold water supplied from the evaporator becomes lower than the second set temperature value T2, the control of the heating amount Q1 of the absorption liquid using the first set temperature value T1 as the reference value is started again.

In the first method, a third method is provided, wherein in a state that the heating amount Q2 of the absorption liquid is forcibly controlled to be zero, when a temperature T of the cold water supplied from the evaporator exceeds a third set temperature value T3 higher than the second set temperature value T2, the control of the heating amount Q2 of the absorption liquid using the second set temperature value T2 as the reference value is started again.

DETAILED DESCRIPTION OF THE PREFERRED EMBODIMENTS

Next, description will be made in detail for preferred embodiments of the present invention with reference to the drawings.

Figure 1:
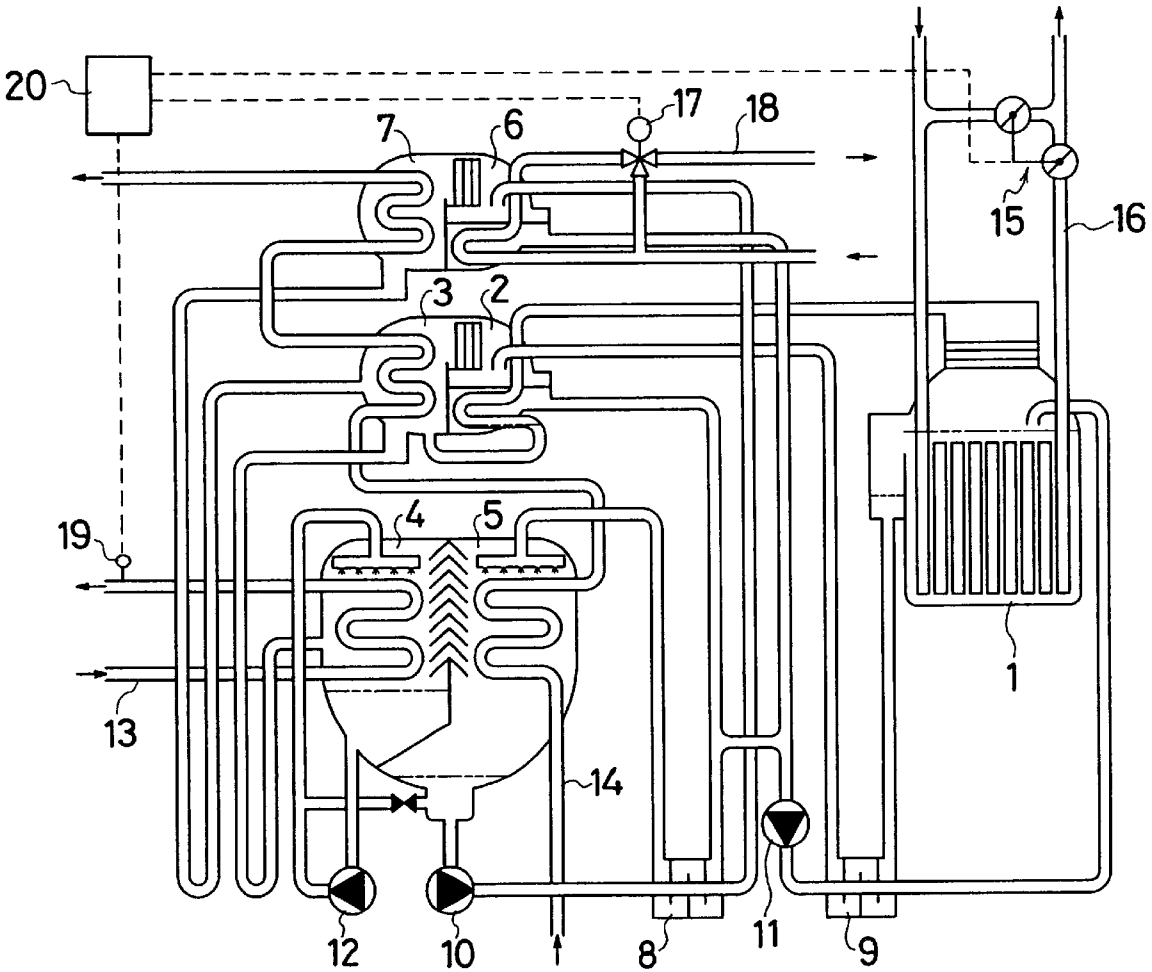
FIG. 1 is an explanatory view showing an apparatus constitution.

An absorption refrigerator exemplified in FIG. 1 is configured such that an absorption liquid is heated by heat exchange with exhaust gas of high-temperature (for example, 650° C.), which is supplied from a cogeneration system or the like as exhaust heat, and also heated by heat exchange with exhaust hot water of intermediate temperature (for example, 88° C).

In FIG. 1, the reference numeral 1 denotes a high-temperature regenerator, 2 a low-temperature regenerator, 3 a condenser, 4 an evaporator, 5 an absorber, 6 a low-temperature water regenerator, 7 a low-temperature water condenser, 8 a low-temperature heat exchanger, 9 a high-temperature heat exchanger, 10 and 11 absorption liquid pumps, and 12 a refrigerant pump. These components are connected by piping with each other through absorption liquid pipes and refrigerant pipes as shown in the drawing, so that an absorption liquid and a refrigerant can be severally circulated.

A cold water pipe 13 for circulatively supplying cold water for a not-shown cooling load such as an air conditioner is passed through the evaporator 4. A cooling water pipe 14 is passed serially through the absorber 5, the condenser 3, and the low-temperature water condenser 7.

A high-temperature heat source supply pipe 16 provided with an exhaust gas damper 15 is passed through the high-temperature regenerator 1. The absorption liquid in the high-temperature regenerator 1, which is supplied from the low-temperature water regenerator 6 by the absorption liquid pump 11, is heated by high-temperature exhaust gas. Thus, the refrigerant vapor is evaporated and separated from the absorption liquid, and the absorption liquid is concentrated.

A low-temperature heat source supply pipe 18 provided with an exhaust hot water control valve 17 is passed through the low-temperature water regenerator 6, and a flow of the exhaust hot water supplied to the low-temperature water regenerator 6 can be regulated by regulation of an opening degree of the exhaust hot water control valve 17. Thus, capacity of generating refrigerant vapor by heating the absorption liquid which is supplied by the absorption liquid pump 10 after absorbing the refrigerant in the absorber 5 to decrease in concentration can be controlled.

In the absorption refrigerator configured as described above, cooling water is flown in the cooling water pipe 14, and the high-temperature exhaust gas and the exhaust hot water are supplied respectively from the high-temperature heat source supply pipe 16 and the low-temperature heat source supply pipe 18. Moreover, the absorption liquid pumps 10 and 11 and the refrigerant pump 12 are operated. Accordingly, in the high-temperature regenerator 1, the absorption liquid is heated by the high-temperature exhaust gas supplied by the high-temperature heat source supply pipe 16, and thus the refrigerant vapor and the concentrated absorption liquid are obtained.

The high-temperature refrigerant vapor generated in the high-temperature regenerator 1 is entered into the low-temperature regenerator 2, and heats the absorption liquid which is entered into the low-temperature regenerator 2 via the high-temperature heat exchanger 9 after being concentrated in the high-temperature regenerator 1. The refrigerant vapor releases heat for condensation, and is entered into the condenser 3.

The refrigerant which is heated to be evaporated and separated from the absorption liquid in the low-temperature regenerator 2 is entered into the condenser 3, and condensed to be liquefied by heat exchange with water flowing through the cooling water pipe 14. The liquefied refrigerant is entered into the evaporator 4 together with the refrigerant which is supplied from the high-temperature regenerator 1 and condensed in the low-temperature regenerator 2.

The refrigerant liquid which is entered in the evaporator 4 and pools in the bottom thereof is sprinkled from above by the refrigerant pump 12. The refrigerant liquid is evaporated by heat exchange with water flowing in the cold water pipe 13 to cool the water flowing in the cold water pipe 13.

The refrigerant evaporated in the evaporator 4 is entered into the absorber 5 and absorbed by the absorption liquid which is heated in the low-temperature regenerator 2 and has the refrigerant evaporated and separated therefrom to increase in concentration of the absorption liquid, in other words, which is supplied via the low-temperature heat exchanger 8 and sprinkled from above.

The absorption liquid is entered via the low-temperature heat exchanger 8 into the low-temperature water regenerator 6 by an operation of the absorption liquid pump 10 after absorbing the refrigerant in the absorber 5 to decrease in concentration.

The absorption liquid entered in the low-temperature water regenerator 6 is heated by the exhaust hot water supplied by the low-temperature heat source supply pipe 18, and has the refrigerant vapor separated therefrom to be concentrated. The concentrated absorption liquid is then returned via the high-temperature heat exchanger 9 to the high-temperature regenerator 1 by means of the absorption liquid pump 11.

The refrigerant vapor generated in the low-temperature water regenerator 6 is entered in the low-temperature water condenser 7, and releases heat to the cooling water flowing in the cooling water pipe 14 for condensation. The resultant refrigerant is entered into the evaporator 4 with the condensed liquid, which is supplied after being condensed in the condenser 3, and then sprinkled from above by the refrigerant pump 12.

When the absorption refrigerator is operated as described above, the cold water cooled by heat of vaporization of the refrigerant in the cold water pipe 13 within the evaporator 4 can be circulatively supplied to the not-shown cooling load through the cold water pipe 13. Accordingly, cooling operations such as an air-conditioning operation can be performed.

The reference numeral 20 denotes a controller of the absorption refrigerator having the above-described operational function. The controller 20 is provided with a microcomputer, storage means, and a like. The controller 20 captures temperature information of the cold water cooled in the evaporator 4 and flown out to the cold water pipe 13 by a temperature sensor 19. The temperature sensor 19 is provided on an outlet side of the cold water pipe 13 from the evaporator 4. The controller 20 then controls opening degrees of the exhaust gas damper 15 and the exhaust hot water control valve 17 such that a temperature T of the cold water at the outlet side of the evaporator is maintained at a predetermined temperature, for example a primary setting value (rated temperature) of 7° C. The controller 20 thus regulates the amounts of heat taken from the high-temperature heat source supply pipe 16 and the low-temperature heat source supply pipe 18 (corresponding to heating amounts Q1 and Q2 of the absorption liquid described in the summary of the invention).

For example, the cold water in the cold water pipe 13 returning from the cooling load at a rated temperature of 12° C. is cooled in the evaporator 4 to the primary setting value of 7° C. by preferentially using the exhaust hot water supplied from the exhaust hot water control valve 17 and is circulatively supplied to the cooling load. In such a case, in order to make the cold water temperature T measured by the temperature sensor 19 to be the primary setting value of 7° C., the controller 20 controls the heat amount of the exhaust gas supplied from the high-temperature heat source supply pipe 16 to the high-temperature regenerator 1, specifically the opening degree of the exhaust gas damper 15, by means of the PID control, for example using a reference value of 6° C., which is lower than the primary setting value of 7° C. by 1 degree. Moreover, the controller 20 controls the heat amount of the exhaust hot water supplied from the low-temperature heat source supply pipe 18 to the low-temperature water regenerator 6, specifically the opening degree of the exhaust hot water control valve 17, by means of the PID control, for example using a reference value of 7° C., which is the primary setting value.

Figure 2:
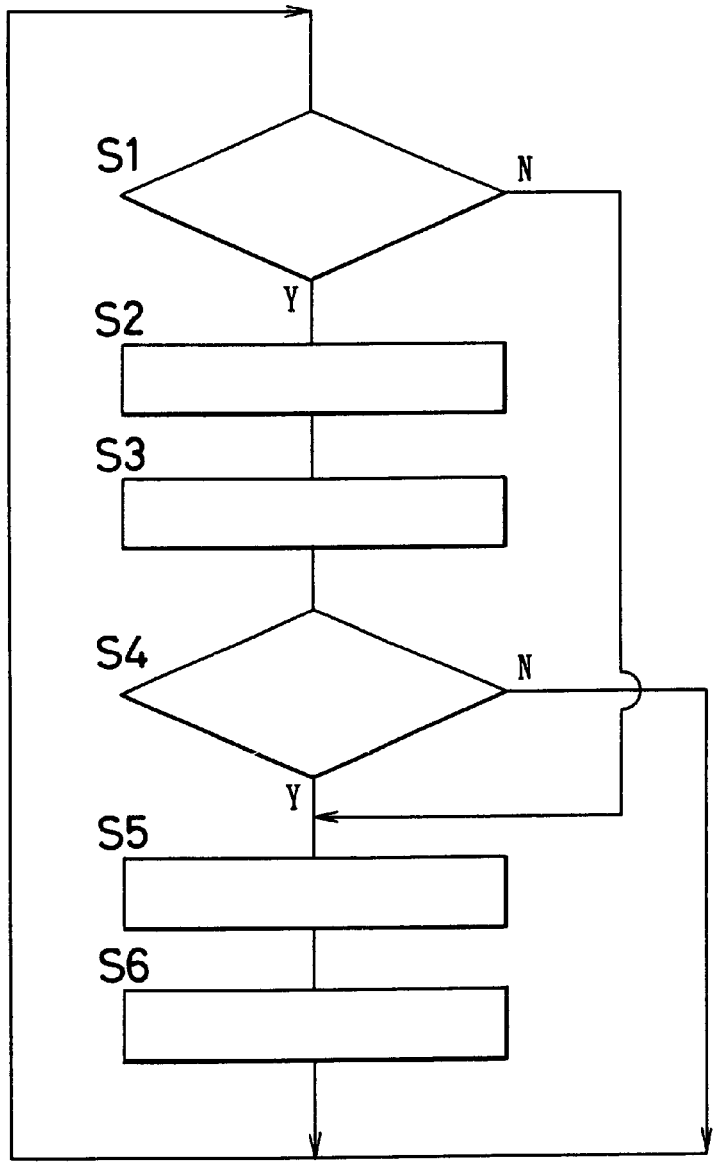
FIG. 2 is an explanatory view showing an example of controlling an exhaust hot water control valve and an exhaust gas damper.

As shown in FIG. 2 for example, when the exhaust gas damper 15 is fully closed continuously for a predetermined time, for example five minutes, the controller 20 forces the exhaust gas damper 15 to be fully closed. In such a state, the controller 20 controls the opening degree of the exhaust hot water control valve 17 by means of the PID control based on the reference value of 6° C. and the temperature T of the cold water measured by the temperature sensor 19.

When the exhaust hot water control valve 17 is fully open continuously for a predetermined time, for example five minutes, the controller 20 forces the exhaust hot water control valve 17 to be fully open. In such a state, the controller 20 controls the opening degree of the exhaust gas damper 15 by means of the PID control based on the reference value of 7° C. and the cold water temperature T measured by the temperature sensor 19.

The control is carried out such that when the result of judgment in a step S1 is no, the controller 20 proceeds to a step S5, and when the result of judgment in a step S4 is no, the controller 20 returns to a step S1.

Figure 3:
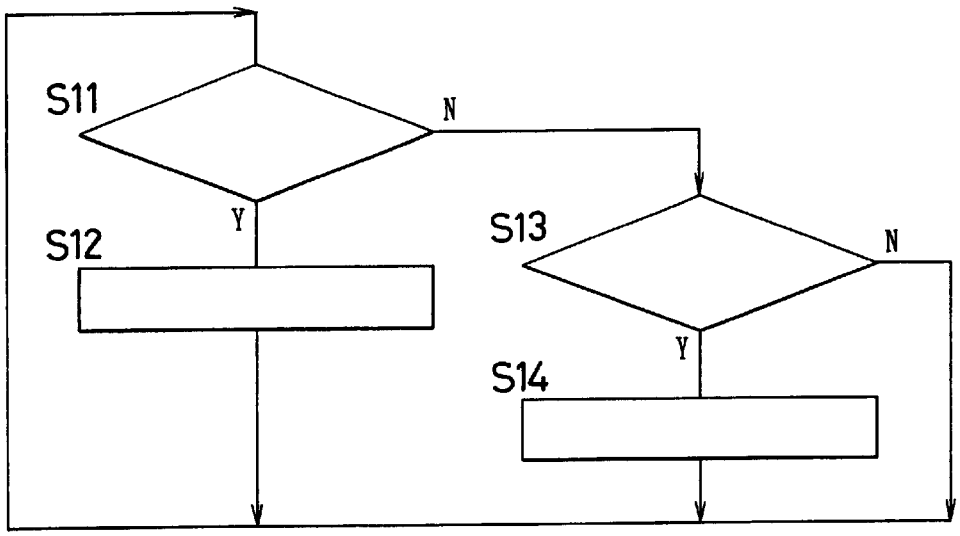
FIG. 3 is an explanatory view showing another example of controlling the exhaust hot water control valve and the exhaust gas damper.
Figure 4:
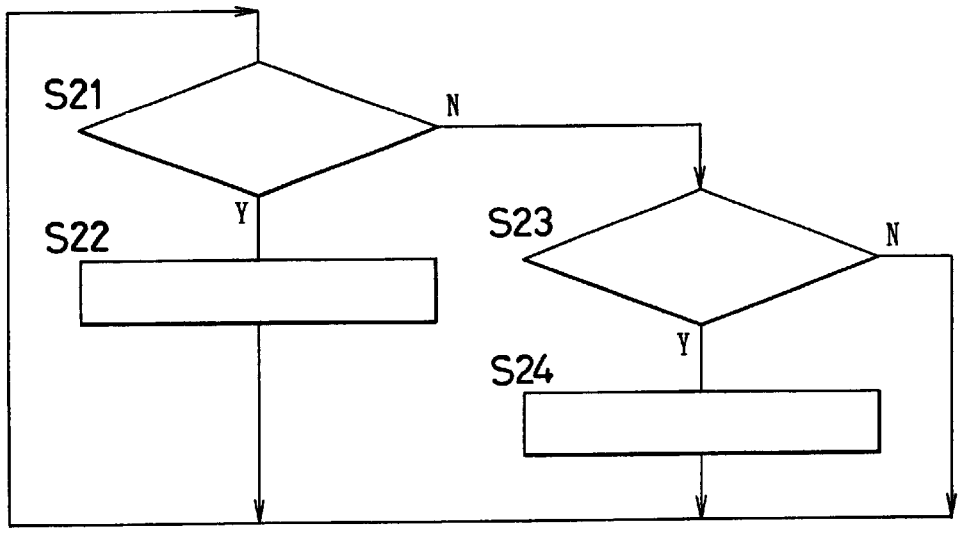
FIG. 4 is an explanatory view showing still another example of controlling the exhaust hot water control valve and the exhaust gas damper.

Furthermore, the controller 20 is configured to control the exhaust gas damper 15 and the exhaust hot water control valve 17 as shown in FIGS. 3 and 4. Specifically, in the case that the cold water temperature T measured by the temperature sensor 19 is lower than the reference value of 6° C., which is lower than the primary setting value of 7° C. by 1 degree, the controller 20 forces the exhaust gas damper 15 to be fully closed. In the other case, the controller 20 judges whether or not the cold water temperature T measured by the temperature sensor 19 is higher than 8° C., which is higher than the primary setting value of 7° C. by 1 degree. When the result of the judgment is yes, the controller 20 releases the forced fully-closed state of the exhaust gas damper 15. When the result of the judgment is no, the controller 20 returns to a step S11.

The controller 20 forces the exhaust hot water control valve 17 to be fully closed in a case that the cold water temperature T measured by the temperature sensor 19 is lower than 5.5° C., which is lower than the primary setting value of 7° C. by 1.5 degree. In the other case, the controller 20 judges whether or not the cold water temperature T measured by the temperature sensor 19 is higher than 6° C., which is lower than the primary setting value of 7° C. by 1 degree. When the result of the judgment is yes, the controller 20 releases the forced fully-closed state of the exhaust hot water control valve 17, and when the result of the judgment is no, the controller 20 returns to a step S21.

By using the combination of the above-described controls shown in FIGS. 3 and 4, the exhaust hot water supplied from the low-temperature heat source supply pipe 18 to the low-temperature water regenerator 6 can be used in preference to the exhaust gas supplied from the high-temperature heat source supply pipe 16 to the high-temperature regenerator 1. Moreover, even if the cooling load is decreased immediately, the cold water circulatively supplied from the evaporator 3 through the cold water pipe 13 to the cooling load is not excessively cooled. Even if the cooling load is increased immediately, it does not occur that decrease in the temperature of the cold water circulatively supplied from the evaporator 3 through the cold water pipe 13 to the cooling load cannot catch up with the increase of the cooling load.

Note that the present invention is not limited to the above-described embodiments, and the various changes may be made therein without departing from the spirit of the appended claims.

For example, the heat source for supplying heat to the high-temperature regenerator 1 may be one utilizing heat of combustion by burning natural gas, oil, or the like with a gas burner provided with the high-temperature regenerator 1.

As described above, according to the present invention, the heat source decided to be preferentially used can be surely used in preference. Moreover, according to claim 2 of the present invention, in the PID control using a wide proportional band or a long integral time, even if the load is decreased immediately, the cold water to be cooled in the evaporator and supplied to the cooling load is not cooled excessively. According to claim 3 of the present invention, even if the cooling load is increased immediately during the similar control, it does not occur that decrease in temperature of the cold water supplied to the cooling load cannot catch up with the increase of the cooling load.

What is claimed is:

1. A method of controlling an absorption refrigerator, comprising the steps of:

controlling a heating amount Q1 of an absorption liquid by a heat source A by means of a control using a first set temperature value T1 of cold water supplied from an evaporator as a reference value, the heat source A being to be preferentially used;

controlling a residual heating amount Q2 of the absorption liquid by a heat source B by means of a control using a second set temperature value T2 higher than the first set temperature value T1 as a reference value;

releasing heat of the refrigerant vapor for condensation in a condenser, the refrigerant vapor being evaporated and separated from the absorption liquid by heating the absorption liquid;

evaporating the condensed liquid refrigerant in the evaporator; and supplying cold water cooled in the evaporation of the refrigerant in the evaporator to a load to perform a cooling operation such as air conditioning; wherein when the heating amount Q2 of the absorption liquid is continuously a minimum value for a predetermined time, the heating amount Q2 of the absorption liquid is reduced to zero and the heating amount Q1 of the absorption liquid is controlled by means of the control using the first set temperature value T1 as a reference value, and wherein when the heating amount Q1 of the absorption liquid is continuously a maximum value for a predetermined time, the heating amount Q1 of the absorption liquid is forcibly controlled to be the maximum value and the heating amount Q2 of the absorption liquid is controlled by means of the control using the second set temperature value T2 as the reference value.

2. The method of controlling an absorption refrigerator according to claim 1, wherein in a state that the heating amount Q1 of the absorption liquid is forcibly controlled to be the maximum value, when a temperature T of the cold water supplied from the evaporator becomes lower than the second set temperature value T2, the control of the heating amount Q1 of the absorption liquid using the first set temperature value T1 as the reference value is started again.

3. The method of controlling an absorption refrigerator according to claim 1, wherein in a state that the heating amount Q2 of the absorption liquid is reduced to zero, when a temperature T of the cold water supplied from the evaporator exceeds a third set temperature value T3 higher than the second set temperature value T2, the control of the heating amount Q2 of the absorption liquid using the second set temperature value T2 as the reference value is started again.

* * * * *